US005613679A

United States Patent [19]

Casa et al.

[11] Patent Number: 5,613,679

[45] Date of Patent: Mar. 25, 1997

[54] METHOD OF PLAYING A LOTTERY GAME

[76] Inventors: Nikko Casa, P.O. Box 390, Cambridge, Mass. 02142; Cynthia C. Frené, 31 Horse Pond Rd., Sudbury, Mass. 01776

[21] Appl. No.: 560,106

[22] Filed: Nov. 17, 1995

[51] Int. Cl.[6] ..... A63F 3/06

[52] U.S. Cl. ..... 273/138.1; 273/139

[58] Field of Search ..... 273/138.1, 138.2, 273/139; 463/17, 18

[56] References Cited

U.S. PATENT DOCUMENTS

| | | | |
|---|---|---|---|
| 5,158,293 | 10/1992 | Mullins | 273/139 |
| 5,186,463 | 2/1993 | Marin et al. | 273/138.2 |
| 5,232,221 | 8/1993 | Sludikoff et al. | 273/139 |
| 5,265,877 | 11/1993 | Boylan et al. | 273/139 |

OTHER PUBLICATIONS

Virginia Lottery Pick 4 and Pick 3, 1991.

*Primary Examiner*—Benjamin H. Layno
*Attorney, Agent, or Firm*—O'Connell Law Firm

[57] ABSTRACT

A method of playing a lottery game wherein a primary random selection from among a group of wagering lottery players is supplemented by a secondary random selection from among a group of potential secondary recipients. The method essentially comprising the steps of accepting a monetary wager from at least one wagering lottery player; securing for each wagering lottery player a player series of indicia comprising a multiplicity of characters; revealing a winning series of player indicia comprising a multiplicity of characters; determining whether any wagering lottery player is a winning player by ascertaining for each player series of indicia whether a predetermined number of characters thereof matches characters of the winning series of player indicia; awarding a valuable prize to the winning player or players, if any; and randomly selecting at least one secondary prize recipient from among a group of eligible secondary recipients.

15 Claims, 4 Drawing Sheets

METHOD OF PLAYING A LOTTERY GAME

FIELD OF THE INVENTION

This invention relates to the field of chance selection. More particularly, it relates to a method of conducting a lottery wagering game wherein a primary random selection of a winner or winners from a group of lottery players is supplemented by the random selection of a secondary prize recipient from a selected group.

BACKGROUND

A lottery is a form of gambling wherein wagering players bet on their being selected by chance to win a valuable prize. In a typical lottery, players buy tickets with a series of characters thereon from authorized sellers at fixed prices. At a subsequent drawing, winning characters are selected on an unpredictable basis for comparison with the players' characters. Players with sufficient matching of characters win valuable prizes.

For hundreds of years, government-run lotteries have been used both to raise public revenues and to supplement or substitute for taxation. For example, a 1680 English lottery raised funds to improve London's water supply equipment, and the Irish Sweepstakes has been a significant source of revenue for many years. In the United States, lotteries disappeared from existence from 1894, when the federal government and many state governments enacted legislation restricting or prohibiting them, until 1963, when New Hampshire authorized a sweepstakes lottery and designated that a portion of the general lottery revenue would be spent on education. Lotteries, found to be relatively painless means of raising revenues while avoiding adding or increasing taxes, have spread quickly to more than half of the United States. Of course, every sponsoring state wishes to get the greatest economic benefit from its lottery.

Unfortunately, certain factors have hampered and even lessened the success of lottery games. For example, lotteries must contend with the widespread view of gambling as a vice. Notwithstanding the lottery's stated public purpose, many have difficulty seeing beyond its undeniably gambling-based roots to appreciate the charitable results of lottery participation. Such persons are joined by many who see lottery participation as wasteful. One may note, however, that these very people are often those who would be most prone to give to charity. With this in mind, it would be advantageous to attract these largely untapped segments of the public to buy lottery tickets. One way of doing this would be by making the charitable aspect of the state lottery more visible, more tangible. One might suspect that, concomitantly with attracting an otherwise non-participating group, a clearer cause-and-effect relationship of lottery participation with public benefit may encourage and sustain those who already participate.

Aside from the public psyche, many argue that the original purposes of many lotteries as fund raisers for local communities have been or have become unsatisfied. Indeed, the faint connection between one's purchasing of a lottery ticket and the benefit exacted upon the communities gives at least the appearance of poorly directed funds. It would be advantageous to make clear and unimpeded the path of at least some of the funds destined for public purposes. Doing so would prove and ensure that allotted monies reach their proper destination (i.e. a school).

With the above in mind, a novel lottery game is needed which would emphasize and capitalize on a lottery's charitable purposes while more directly benefitting the entities for whom, at least in part, the lottery is conducted.

SUMMARY

In contemplation of the above, the principle object of the present invention is to provide a novel lottery game which increases player interest and participation thereby increasing the revenues of sponsoring authorities which adopt the game.

Toward accomplishing the principal object of the invention, it is an underlying object to make more tangible to the player the cause and effect relationship between a player's wagering participation in the lottery and the benefit to the community.

It is a further object of the invention to provide a means of more particularly and directly focusing the influx of monies into entities sought to be benefited by a portion of the lottery's monetary fund.

Still another of the invention's objects is to provide a novel lottery game which may be adopted by sponsoring authorities without a substantial change in present lottery systems.

From this specification, these and other objects and advantages of the present invention will become obvious to those skilled in the art. In carrying out the aforementioned objects, the method of the present invention comprises essentially the steps which will be set forth below. Of course, one must take care to note that, although the steps are set forth in a particular and convenient order, the order of the steps may be altered without departing from the present invention.

With that in mind, one might begin to carry out the present invention by accepting a monetary wager from at least one lottery player. Typically, a portion of these wagers will be contributed to a lottery fund from which prizes may be awarded. Each wagering player would be secured a player series of indicia. In turn, each player series of indicia would be compared to a revealed winning series of player indicia to determine whether any wagering player is a winning player. This determination would be carried out by ascertaining whether there is a sufficient number of matches between the player series of indicia and the winning series of player indicia as dictated by the sponsoring authority's distribution method. Any winning player would be awarded a valuable prize. This primary lottery would be supplemented by the random selection of at least one secondary prize recipient from a selected group.

In certain embodiments of the invention, the random selection of a secondary recipient may happen within the same event as the revelation of the winning series of indicia. However, it is possible that they may be temporally separate. It is also contemplated that players may be provided with a means of selecting their own series of indicia, or the indicia may be selected for them. In preferred embodiments, the winning series of indicia will be determined by a central, random drawing. Typical secondary recipients may be chosen from among a predetermined group of, for example, non-wagering scholastic institutions or other public or charitable bodies.

The random selection of a secondary recipient may or may not be dictated by the winning series of player indicia. A random selection of the secondary recipient (i.e. a school) may be accomplished in any of several ways such as by compiling a list of eligible schools, assigning each school a scholastic series of indicia, revealing a winning series of scholastic indicia, and determining whether any school is a winning school by comparing the scholastic series of indicia with the winning series of scholastic indicia for sufficient matching. One may surmise that the winning series of scholastic indicia need not be distinct from the winning series of player indicia.

In a particularly preferred embodiment, each school or other secondary recipient is removed upon winning from the list of eligible secondary recipients until all eligible schools have won. Once equity has been done and all schools have won, the list is reconstituted. Alternatively, sponsoring authorities may wish to reconstitute the list after a set time regardless of whether all eligible schools have won. It may be preferred still further to make the value of the prize awarded the secondary recipient proportionate to the relative size of the recipient.

It may be most optimum that the group of indicia from which the lottery indicia can be selected are chosen to be appropriate to the lottery's secondary recipient group. For example, where the secondary recipient is to be chosen from a group of schools, an appropriate theme for the lottery may be related to education. In furtherance of that theme, the series of indicia may be chosen from an alphabetical group of indicia. In a particularly preferred embodiment, the player may select five characters as the player series of indicia from a closed alphabetic set, and the winning series of player indicia may be drawn without replacement from a closed group comprised of letters of the alphabet. The characters available for selection may be comprised of the complete alphabet or they may be comprised of some subset thereof. In either situation, each series of indicia may be comprised of five alphabetic characters.

A further refinement of such an embodiment may supplement the five alphabetic characters in at least the winning series of player indicia with a numerical character from zero to nine inclusive. This character may be used, not for determining winners, but instead to amplify or otherwise to affect the prize to be collected by the winner.

In the past, lottery funds have been distributed according to largely unseen legislative formulas. While such distribution often is not clear to the public, one knowledgeable in the art would be aware that some portion was destined for the lottery commission and another, larger, portion would be apportioned to state and local communities. Unfortunately, this generally unseen method of funds distribution has had two effects: the public tends to forget that a significant portion of their wager will be allocated to state and local communities, and the present funds distribution system tends to dissipate the effect of the money over many entities and thereby diminishes the cognizable effect on each individual entity.

With these things in mind, one can appreciate better the advantages of the present invention. By the novel inclusion of a secondary drawing, the disadvantages inherent in past lotteries are removed. Assume, for example, that the secondary drawing recipient is a school chosen from a statewide group of schools. In televised drawings, advertisements, and the like, discussion of the charitable effects of lottery gambling will be included unavoidably. Wagering players will be reminded consistently that at least some of their gambling money is charity's gain. With some of the tinge of waste and vice removed, one could expect lottery participation to increase. Increased participation would cause a consonant increase in lottery revenue. The cyclical effect of this increased participation would be greater monies for lottery winners, the state, and secondary recipients.

In addition to increasing the stakes for all involved in the lottery financial cycle, the secondary drawing would have a profound effect on the way in which money is forwarded to local communities. Unlike the prior art system in which the effects are diffuse and substantially intangible, the system of the present invention would inject large amounts of cash into a single recipient entity's budget in a more focused manner. With a large, single-transaction cash award, a recipient entity could undertake and fund significant projects. Since the optimally-preferred embodiment of the invention contemplates each winning entity's being excluded from winning again until all eligibly entities have won, the system ensures that all eligible recipients will benefit.

The foregoing discussion broadly outlines the more important features of the invention to enable a better understanding of the detailed description that follows and to instill a better appreciation of the invention's contribution to the art. Before an embodiment of the invention is explained in detail, it must be made clear that the following details, descriptions, and illustrations are merely exemplary of a possible manifestation of the invention.

DETAILED DESCRIPTION OF A PREFERRED EMBODIMENT

The present invention is for a lottery game wherein a primary selection from among a group of wagering players is supplemented by an additional random selection in which a secondary recipient such as a non-wagering school is selected to receive a valuable prize. The detailed description which is to follow will set forth, by way of example, one particularly preferred embodiment which the invention might take.

Figure 1:
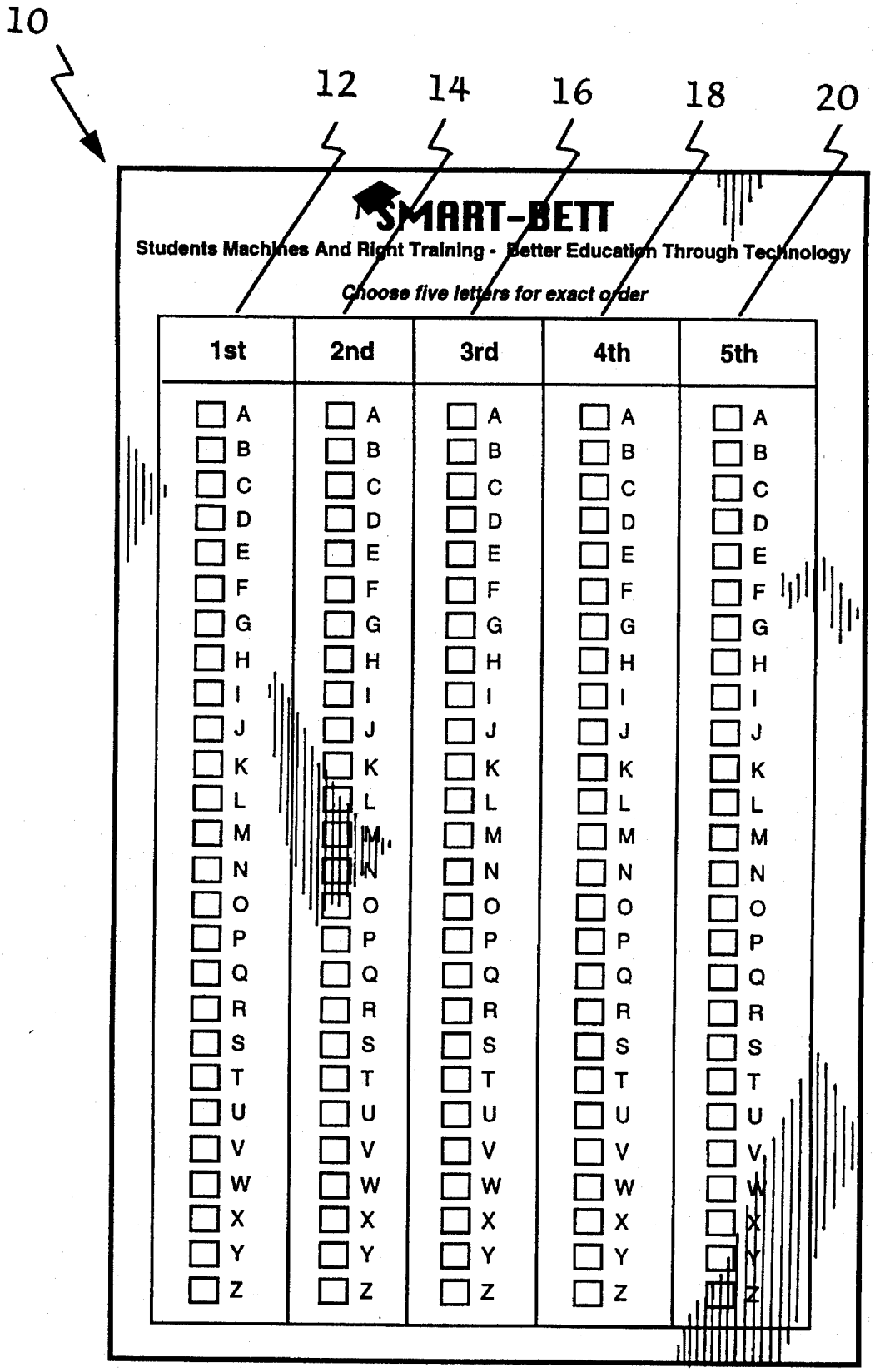
FIG. 1 is a sample playslip in blank.

For greatest clarity, the most preferred embodiment of the invention will be described herein with illustrative reference to the included drawing figures. Play of the lottery game would begin typically with a prospective player's securing of a lottery playslip such as that shown at 10 in FIG. 1. In a basic form, the playslip 10 includes five vertical columns 12, 14, 16, 18, and 20. Each of the columns 12, 14, 16, 18, and 20 enumerates in order all characters available for selection in the game. Beside each character in each column 12, 14, 16, 18, and 20 there is an empty box. In the instant case, there are twenty-six available characters since the character set is comprised of all letters in the English alphabet: A through Z.

Figure 3:
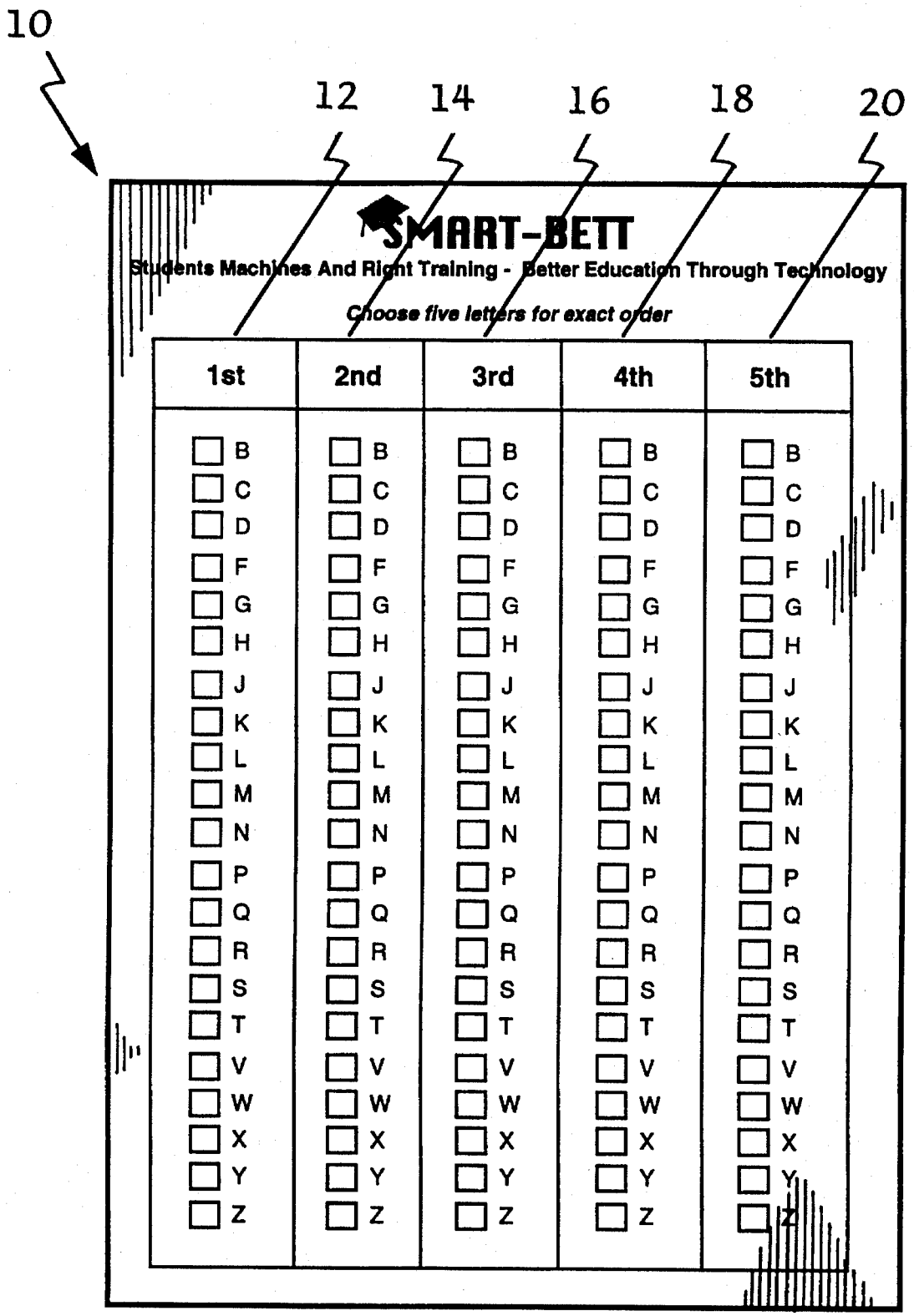
FIG. 3 is an alternative sample playslip in blank.

However, one must be mindful that the number and type of characters available for selection is of little consequence to the invention. For example, to manipulate the odds, certain characters may be added or deleted. An alternatively preferred embodiment is shown in FIG. 3 wherein the columns of characters include only the consonants of the alphabet. By deleting available characters, players would be more likely to win.

Next, the player would select the player's series of indicia. These are the characters which the player wagers will later be selected as the winning series of player indicia. For proper indicia selection, the player blackens a single box in each of the five vertical columns 12, 14, 16, 18, and 20. Alternatively or optionally, the player series of indicia may be selected randomly for the player by, for instance, a lottery computer of the type currently common in the art. Since the winning indicia will be selected from a closed set of characters without replacement and consequently no character could repeat itself in a given winning series of player indicia, a player cannot select any character more than once in the five vertical alphabetical columns 12, 14, 16, 18, and 20.

Figure 2:
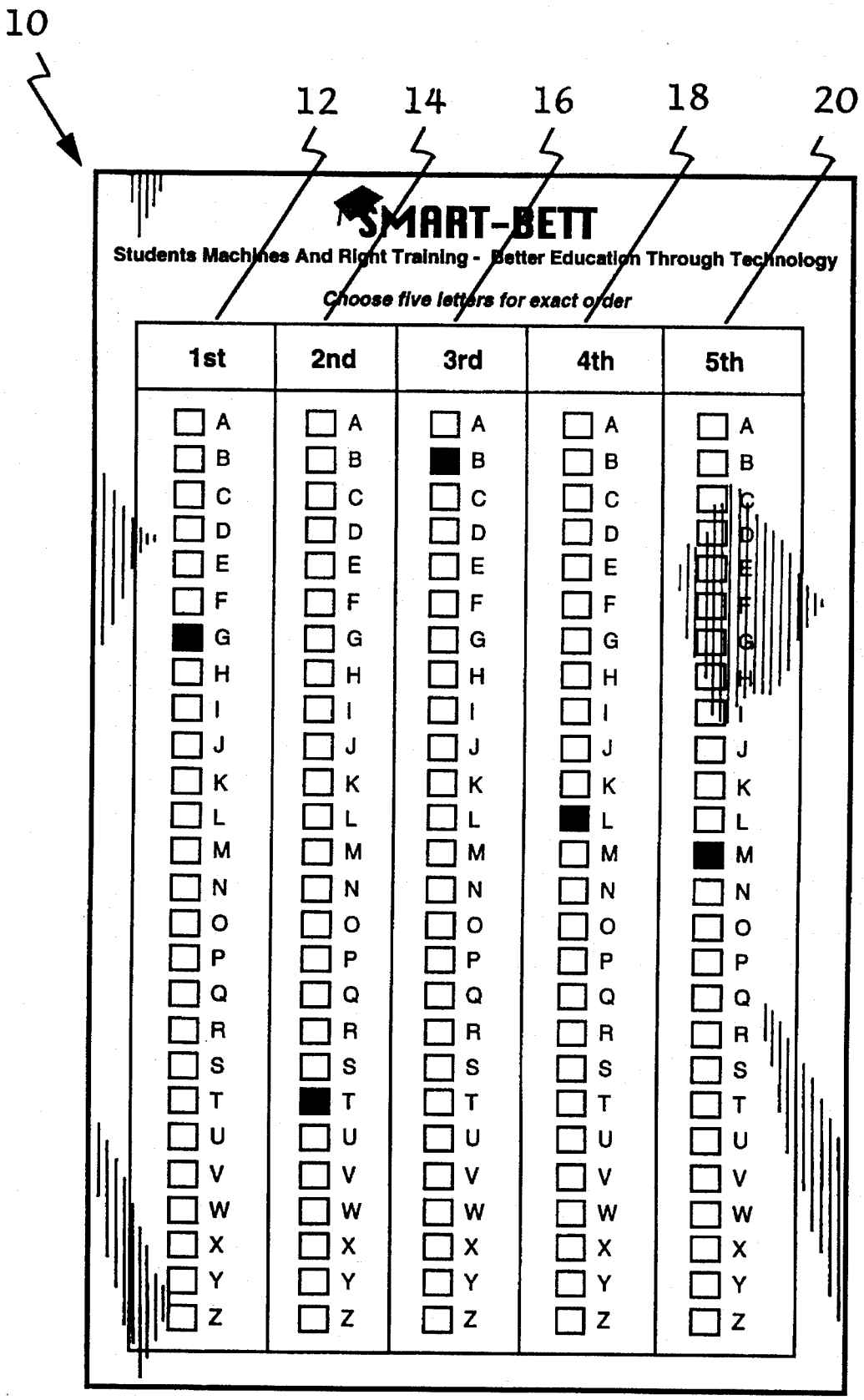
FIG. 2 is a sample playslip which has been marked by the blackening of selected character boxes thereon.

FIG. 2 shows the player's playslip 12 with the chosen player series of indicia blackened. As one can see, by blackening the appropriate boxes the player chose the letter G in the first column 12, the letter T in the second column 14, the letter B in the third column 16, the letter L in the fourth column 18, and the letter M in the fifth column 20.

Figure 4:
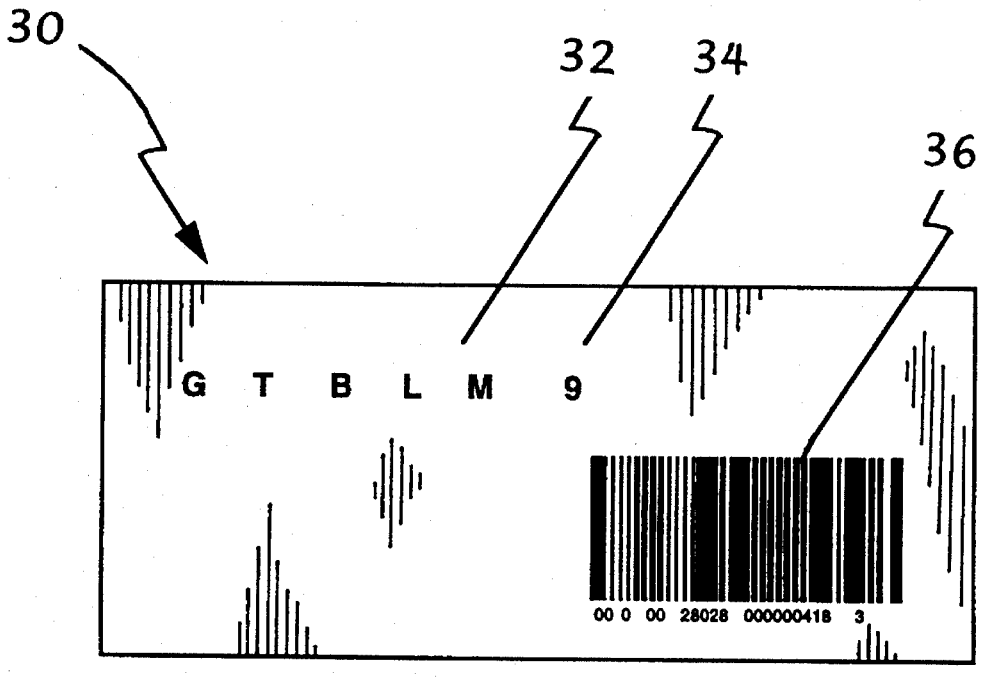
FIG. 4 is a sample ticket which would result from the playslip of FIG. 2.

Next, the player would present the completed playslip 10 to an authorized lottery sales representative along with the requisite wager as designated by the lottery commission. Using available technology, the lottery agent would transcribe the characters G, T, B, L, and M from the playslip 10 onto a lottery ticket 30 which is shown in FIG. 4. The characters G, T, B, L, and M comprise the player series of indicia 32. As one might notice, the lottery ticket 30 further includes the number 9 alongside the player series of indicia 32. This is the player's bonus number 34.

In practice, the bonus number 34 can be used as a multiplier of the player's prize (assuming, of course, that the player wins a prize) based on the bonus number's numerical value. In this most preferred embodiment, the lottery computer randomly selects and applies a bonus number 34 to the player's ticket 30 by means known in the art. Accordingly, if this ticket 30 were to be a winning ticket and the player's bonus number 34 matched a revealed winning bonus number, the player's prize would be multiplied by 9. Although not imperative, it is most practical that the bonus number 34 not be selected by the player since one might expect nearly all players to choose high prize-multiplying bonus numbers if it were within their control. Alternatively, it is possible that a bonus number may be selected for all winning players at the central, random drawing. In that case, the bonus number would automatically multiply the jackpot prize to be awarded winning players. Optionally, the ticket 30 may be bar coded or otherwise marked to provide any desired information for validation purposes. Lottery ticket 30 is shown with ticket-verification bar code 36.

The next major event in the lottery process is the revelation of the winning series of player indicia. In the preferred embodiment, the winning series of player indicia is determined by a central, random drawing conducted by lottery officials at a specified time and place. Of course, the winning series of player indicia is chosen from the same closed set of characters as the player series of indicia. Any method of random character selection which ensures completely random selection of winning indicia by lottery officials is satisfactory. For example, a well known and accepted method of random character selection employs a mixing chamber in which a plurality of identically weighted balls are mixed by blowing air. The number of balls should be equal to the number of characters in the closed set, in this case twenty-six. Each ball is marked with a different letter of the alphabet. Of course, any dosed set may be used instead of the complete alphabet. For instance, the balls could be numbered from one to thirty-six or could include some variation from the complete alphabet.

In practice, the mixing chamber is used to select a certain number of balls, such as four, five, or six. The mixing chamber includes a means for choosing and removing balls at random. It is important that the selection of the winning series of player indicia be absolutely random so that the odds of winning a prize are knowable and trustworthy. Once a ball is chosen and removed from the mixing chamber, it is not replaced in the chamber. Consequently, each character is eligible to appear only once. Alternatively, the invention may be modified by having as many mixing chambers as there are characters in the player series of indicia. In that case, each chamber would contain the complete character set, and it would be possible for the same character to appear multiple times in both the player series of indicia and the winning series of player indicia. In any case, five balls are chosen, and these comprise the winning series of player indicia.

In addition to the mixing chamber for the random selection of the alphabetical characters, the preferred embodiment includes another mixing chamber which contains, as a closed set, the numbers from zero to nine, inclusive. By means similar to that of the alphabetical mixing chamber, a single, numbered ball is chosen and removed randomly from among the ten numbered balls. This ball is called the bonus ball.

As has become common in the art, one might expect the random drawing of the winning series of player indicia to be carried out at a designated time and at a central location by lottery officials. It may be televised and even more likely would be reported in newspapers. Consequently, one might expect observant players who know the particular lottery commission's manner of prize distribution to realize when that player has won. Further, the lottery computer system typically would include means common in the art to determine whether any winning players exist. Also, the preferred embodiment contemplates the lottery commission's being able to use present technology to verify the winning status of a given ticket such as via the bar code 36 which has been included on the ticket 30.

It would be obvious to one skilled in the art that the precise manner in which the prize pool is allocated to winning players is subject to the discretion of the sponsoring authority. This allocation is related to the odds in the game and would vary in accordance with the number of characters in the set from which characters may be selected and the particular motivations of the sponsoring authority. The distribution method set forth below may be considered as an acceptable example of one of the many variations possible.

In the preferred embodiment, a monetary Jackpot Prize is awarded to a player whose player series of indicia matches the winning series of player indicia exactly, in both kind and order. Such a winning player would win a Super Jackpot if, in addition to matching the five alphabetical characters exactly, the player's bonus number matches the bonus number randomly selected in the drawing. It is contemplated further that a player whose ticket includes all of the winning series of player indicia, but not in exact order, shall win a prize of somewhat lesser value than the jackpot prize. A prize of still lower value may be awarded to players who match four winning characters. Finally, prizes such as tickets may be awarded to players who match three letters in any order. In any case, a matching bonus number becomes a jackpot multiplier according to its numerical value.

The lottery drawing described above may be termed for convenience the primary drawing. As is now clear, that primary drawing selects by chance a winner or winners from a group of wagering lottery players. Although unique, that primary chance selection likely would be of marginal help towards satisfying the needs which prior art lottery drawings have left unfulfilled. With this in mind, the present invention supplements the primary chance selection with a secondary chance selection which will be described below. For reasons which will be summarized herein, it is offered that the present invention's inclusion of a secondary drawing for choosing a secondary recipient of a valuable prize meets those needs in a most advantageous way.

Most optimally, the secondary chance selection would be designed to choose at random a non-wagering recipient of a portion of a lottery fund generated by the players' monetary wagers. In light of the fact that a certain portion of the lottery fund is destined for injection into state and local communities, the prize awarded this non-wagering secondary drawing winner would likely be drawn from that portion. It is preferred that the parties eligible to win this secondary drawing be compiled into a closed group of like members. For example, the group of non-wagering secondary recipients eligible to win may be comprised of a group of charitable or public institutions. It may be most preferable that the winning secondary recipient be chosen from a group of non-wagering public schools. The outcome of the secondary drawing may be controlled by the winning series of player indicia, or it may be independent thereof. Although it may be most practical to conduct the secondary drawing during the same event as the primary drawing, this is by no means necessary to the invention.

The random selection of a secondary recipient such as a school is performed most preferably by first compiling a list of eligible scholastic institutions. With that, each of these schools may be assigned a number, possibly at random. For instance, two hundred schools each could be assigned a scholastic series of indicia comprising a number from one to two hundred. Each school's numbers may be termed that school's scholastic series of indicia. It is contemplated that no two schools would have the same number. Next, a winning series of scholastic indicia comprising a number from one to two hundred could be chosen. The most suitable means of choosing the winning series of scholastic indicia may be a mixing chamber similar to those used in the primary drawing.

Assuming the use of a mixing chamber, each school's number may be placed on a ball, and each ball may be placed in an appropriately-sized chamber. Lottery officials then would select at least one non-wagering school from among the group of eligible schools by employing the mixing chamber's random selection capabilities. Since the motivation of the secondary drawing is equitable, it would be most preferable that the ball of each winning school would not be replaced into the mixing chamber until all eligible institutions have won. Once the final member of the group of secondary recipients has won, the list of eligible institutions may be reconstituted. Of course, the group of eligible institutions may be comprised again of schools. However, it is contemplated that the sponsoring authority may wish to choose different groups of eligible secondary recipients to spread the benefits of this novel lottery system most fairly.

From the foregoing, it is apparent that the present invention has many advantages, including the ability to increase player interest and participation in the lottery game by employing, inter alia, a secondary drawing to make more tangible to players the cause and effect relationship between lottery wagering and particular community benefit. The increased participation caused by the game will yield a consequentially increased revenue for sponsoring authorities which adopt the invention. A further benefit of the present invention is the more particular and direct injection of money into select community entities with the resulting advantage of enabling recipients to undertake substantial and focused projects. Advantageously, the present invention may be adopted without substantial modification of most present lottery systems. These and other advantages will obvious to those skilled in the art who learn of this invention.

The foregoing discussion is set forth merely as an example of a given manifestation of the inventive concept, and those skilled in the art will appreciate that concept may give rise to other forms. Therefore, the claims which follow shall be deemed to include such equivalent constructions insofar as they do not depart from the spirit and scope of the present invention.

We claim:

1. A method of conducting a lottery game wherein a primary random selection from among a group of wagering lottery players is suppplemented by a secondary random selection from among a group of potential secondary recipients, the method comprising the steps of:

a) accepting a monetary wager from at least one wagering lottery player;

b) securing for each wagering lottery player a player series of indicia comprising a multiplicity of characters;

c) revealing a winning series of player indicia comprising a multiplicity of characters;

d) determining whether any wagering lottery player is a winning player by ascertaining for each player series of indicia whether a predetermined number of characters thereof matches characters of the winning series of player indicia;

e) awarding a valuable prize to the winning player of players, if any;

f) randomly selecting at least one secondary prize recipient; and g) randomly selecting a bonus number from a closed set of numbers and multiplying winning players valuable prizes by the bonus number.

2. The method of claim 1, further comprising the steps of securing to the player a player bonus number, randomly selecting a winning bonus number, and multiplying by the value of the winning bonus number a winning player's valuable prize if the player's bonus number matches the winning bonus number.

3. The method of claim 1, wherein the step of randomly selecting at least one secondary prize recipient comprises the random selection of a recipient or recipients from among a predetermined group of non-wagering charitable recipients.

4. The method of claim 1, wherein the step of randomly selecting at least one secondary prize recipient comprises the random selection of a recipient or recipients from among a predetermined group of non-wagering public institutions.

5. The method of claim 1, wherein the step of randomly selecting at least one secondary prize recipient comprises the random selection of a recipient or recipients from among a predetermined group of non-wagering scholastic institutions.

6. A method of conducting a lottery game wherein a primary random selection from among a group of wagering lottery players is supplemented by a secondary random selection from among a group of eligible, non-wagering secondary recipients, the method comprising the steps of:

a) accepting monetary wagers from a number of wagering lottery players;

b) securing for each wagering lottery player a player series of indicia comprising a multiplicity of characters;

c) selecting by a central, random drawing a winning series of player indicia comprising a multiplicity of characters;

d) determining whether any wagering lottery player is a winning player by ascertaining for each player series of indicia whether a predetermined number of characters thereof matches characters of the winning series of player indicia;

e) awarding a valuable prize to the winning player or players, if any; and f) randomly selecting at least one secondary prize recipient from among a predetermined group of eligible, non-wagering secondary recipients.

7. The method of claim 6 wherein the step of randomly selecting at least one secondary prize recipient generated by monetary wagering is dictated by the winning series of player indicia.

8. The method of claim 6 wherein the step of randomly selecting at least one secondary prize recipient is comprised of the steps of compiling a list of eligible secondary recipients, assigning each eligible secondary recipient a recipient series of indicia, revealing a winning series of recipient indicia, determining which, if any, eligible secondary recipient is a winning secondary recipient by determining whether there is sufficient matching between the recipient series of indicia and the winning series of recipient indicia.

9. The method of claim 8 further comprising the steps of removing each winning secondary recipient from the list of eligible secondary recipients and compiling a new list of eligible secondary recipients once all eligible secondary recipients have won.

10. The method of claim 8 further comprising the steps of removing each winning secondary recipient from the list of eligible secondary recipients and compiling a new list of eligible secondary recipients once all eligible secondary recipients have won or upon the passing of a set period of time, whichever occurs first.

11. The method of claim 6 wherein the player series of indicia and the winning series of player indicia are each comprised of letters chosen from the English alphabet.

12. The method of claim 6 wherein the player series of indicia and the winning series of player indicia each further include a bonus number, and the method further including the step of multiplying a winning player's prize by the bonus number when the player's bonus number matches the winning bonus number.

13. The method of claim 6 further comprising the step of selecting the winning series of player indicia through a central, random drawing wherein the winning indicia are selected from a closed group without replacement whereby each indicia can appear among the winning series of player indicia only once.

14. The method of claim 6 further comprising the step of selecting the winning series of player indicia through a central, random drawing wherein each of the winning indicia is selected from a complete set of eligible characters whereby each indicia can appear among the winning series of player indicia more than once.

15. The method of claim 6 wherein the step of randomly selecting at least one secondary recipient of a portion of the lottery fund comprises the random selection of a recipient or recipients from among a predetermined group of non-wagering scholastic institutions.

* * * * *